US005800088A

United States Patent [19]

Lückhof et al.

[11] Patent Number: 5,800,088

[45] Date of Patent: Sep. 1, 1998

[54] QUICK-CHANGING DEVICE FOR ROLL DISKS

[75] Inventors: Lothar Lückhof, Herne; Herbert Berendes, Mülheim, both of Germany

[73] Assignee: Mannesmann Aktiengesellschaft, Düsseldorf, Germany

[21] Appl. No.: 593,791

[22] Filed: Jan. 30, 1996

[30] Foreign Application Priority Data

Jan. 30, 1995 [DE] Germany ..... 195 03 682.4

[51] Int. Cl.[6] ..... F16B 7/20

[52] U.S. Cl. ..... 403/349; 403/348; 72/238

[58] Field of Search ..... 72/237, 238; 403/348, 403/349

[56] References Cited

U.S. PATENT DOCUMENTS

| | | | |
|---|---|---|---|
| 2,381,905 | 8/1945 | Hoffman | 403/348 X |
| 3,541,830 | 11/1970 | Bohnenkamp et al. | 72/238 |
| 3,596,944 | 8/1971 | Ecker et al. | 403/348 X |
| 3,985,013 | 10/1976 | Pillon et al. | 72/238 |
| 4,197,762 | 4/1980 | Yamana | 403/348 X |
| 5,029,461 | 7/1991 | Lawrence et al. | 72/238 |

FOREIGN PATENT DOCUMENTS

| | | | |
|---|---|---|---|
| 1602315 | 5/1970 | Germany | 72/238 |
| 3030040 | 3/1982 | Germany | 72/238 |
| 94/21396 | 9/1994 | WIPO | 72/238 |

OTHER PUBLICATIONS

Forni et al. "Roughing mills with cantilevered rolls" from Iron and Steel Engineer, pp. 23–27, Dec. 1984.

*Primary Examiner*—Kenneth J. Dorner
*Assistant Examiner*—Andrea Chop
*Attorney, Agent, or Firm*—Cohen, Pontani Lieberman & Pavane

[57] ABSTRACT

A device for changing a roll disk arranged in a free-floating fashion on a roll shaft and braced against a shoulder of the roll shaft, the device including a roll shaft piece connectable to an end face of the roll shaft and having radially projecting claws. An installation-and-removal unit is placeable on and coaxially turnable to the roll shaft. The unit has radially extending first, second and third claws that form perimeter segments. The first claws correspond to and engage with the claws of the roll shaft piece. A taper bushing is slidably provided between the roll disk and the roll shaft to hold the roll disk on the roll shaft, and has radially extending claws. The second claws correspond to and engage with the taper bushing claws, and are also moveable axially to the roll shaft. A ring is coaxially mounted on a side of the roll disk facing the unit, and has radially extending claws that correspond to and engage behind the third claws. All the claws have a perimeter extension whereby the corresponding claws lie perimetrically next to one another in a plane seen in the axial direction when the unit is placed on the roll shaft. The unit is turnable between a first position in which the claws of the roll shaft piece and the taper bushing respectively engage with the first and second claws, and a second position in which only the claws of the ring engage with the third claws.

5 Claims, 2 Drawing Sheets

QUICK-CHANGING DEVICE FOR ROLL DISKS

BACKGROUND OF THE INVENTION

1. Field of the Invention

The invention relates to a quick-changing device for roll disks, especially large roll disks, that are arranged on roll shafts in a free-floating fashion and braced adjacently against a roll shaft shoulder. Such a quick-changing device includes an axially moveable installation-and-removal device which can be placed frontally on the roll shaft and turned by a number of degrees relative and coaxially to the roll shaft. The installation-and-removal device has claws that extend radially--in the manner of a bayonet joint--over perimeter segments thereof. After the installation-and-removal device has been mounted and turned, some of these claws grip behind correspondingly designed claws of a frontally arranged roll set, while other of the claws grip behind claws arranged on the taper bushing for gripping the roll. Furthermore, the claws of the installation-and-removal device that are associated with the claws of the taper bushing can be moved within the installation-and-removal device axis-parallel to the roll shaft. The invention also relates to procedures for, respectively, removing and installing roll disks arranged on roll shafts in a free-floating fashion and braced adjacently against a roll shaft shoulder.

2. Description of the Prior Art

It is known that roll disks are parts that are subject to wear, which results in the necessity of changing the parts regularly. Changing roll disks, especially large roll disks, is very expensive because the process consists largely of manual labor carried out with the help of a crane. Because of the problems posed by handling the heavy roll disks, production is interrupted for a considerable time, which cuts into production time. Moreover, operating personnel must be provided to carry out the necessary steps, some of which require physical strength, especially in order to remove the roll disks from the roll shaft and to put the new roll disks into place.

The use of quick-changing devices is known in the prior art. Specifically, there are respective devices for installing and removing roll disks which can be placed frontally on the roll shaft and brace or release the roll disk. Although it is possible to brace or release the roll disks using these mounting and removal devices, transport must nonetheless be carried out using other means. It is obvious that the manual labor required in connection with these mounting and removal devices also poses a significant danger of accident to the personnel assigned to these tasks.

SUMMARY OF THE INVENTION

Accordingly, it is the object of the present invention is to provide a quick-changing device for generic roll disks, which device allows the fastest possible change of roll disks to be carried out, in order to minimize the interruption of production. Due to the inventive device, the increase in production performance is simultaneously accompanied by savings in operating personnel and a reduced risk of accidents. With the present invention a fully automated roll change is made possible using a single device which permits accurately-positioned and reliable mounting and removal of new or overhauled roll disks.

Pursuant to this object, and others which will become apparent hereafter, one aspect of the present invention resides in arranging a further ring, designed in the fashion of a bayonet joint, coaxially on the front of the roll disk so as to face the installation-and-removal device. When the installation-and-removal device is turned to a certain position, the further ring has radially extending claws that grip behind additional claws provided on the installation-and-removal device. The segments of the individual claws have a perimeter extension such that when the installation-and removal-device is mounted on the roll shaft, the claws of a claw pair provided for mutual gripping lie next to one another in their perimeter directions in the projection plane seen in the axial direction. When the installation-and-removal device is in a first turned position, at least the claws of the roll shaft and of the taper bushing grip behind the respective associated claws of the claw pairs. When the installation-and-removal device is in a second turned position, which makes possible the installation and removal of the roll disk, only the claw pairs of the ring designed in bayonet-joint fashion are engaged with the additional claws provided on the installation-and-removal device.

The crux of the present invention is the fact that the turning movement of the known quick-changing device used to release the roll disk is now also used to grasp the roll disk in a certain turned position for transport and for removal of the roll disk together with the installation-and-removal device. The quick-changing device according to the invention thus has, including the mounting position, three different turned positions. In the first turned position, the device is slipped onto the roll shaft—with or without a roll disk. In the second turned position, the release (known per se) of the roll disk is carried out. In the third turned position, the roll disk is gripped by the installation-and-removal device and removed from the roll shaft.

As a result, the quick-changing device can be operated in a fully automatic fashion. Furthermore, separate devices for removing and transporting the roll disk are no longer necessary.

In a further embodiment of the invention, the claws of the claw pairs between the roll shaft and the installation-and-removal device, as well as the claws of the claw pairs between the taper bushing and the installation-and-removal device, are evenly distributed around the perimeter of the shaft and, in each case, encompass a perimeter segment of 45 degrees. Preferably, the claw pairs associated with the ring designed in the fashion of a bayonet joint, which are also evenly distributed around the perimeter, encompass respective perimeter segments of approximately 30 degrees each. In this embodiment of the invention, the three turned positions of the installation-and-removal device can be achieved especially advantageously, ensuring an optimal holding strength of the claw pairs and reliable mounting and removal of the roll disks.

In a further embodiment of the invention, the claws of the installation-and-removal device associated with the taper bushing are arranged on a coaxial ring piston arranged in the installation-and-removal device in a non-rotatable manner. The piston is subjected t o a pressure medium on both sides so that the ring piston can be moved back and forth. The ring piston allow s the claws associated with the taper bushing to move independently of the installation-and-removal device, as required, in order to draw out the taper bushing between the roll disk and the roll shaft.

In addition to the function discussed above, it is particularly advantageous to simultaneously use the ring piston for mounting the roll disk, since the ring piston can be placed frontally against the taper bushing and/or the roll disk. This is possible due to the fact that the ring piston, can be subjected to a pressure medium on both sides.

In an especially advantageous fashion, the present invention makes it possible to substantially reduce roll changing time. Operating personnel can be reduced to one man, for whom the risk of accident is clearly decreased by the automatic grasping of the roll disk. Thus, by using the device according to the invention, a remarkable increase in production can be achieved.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
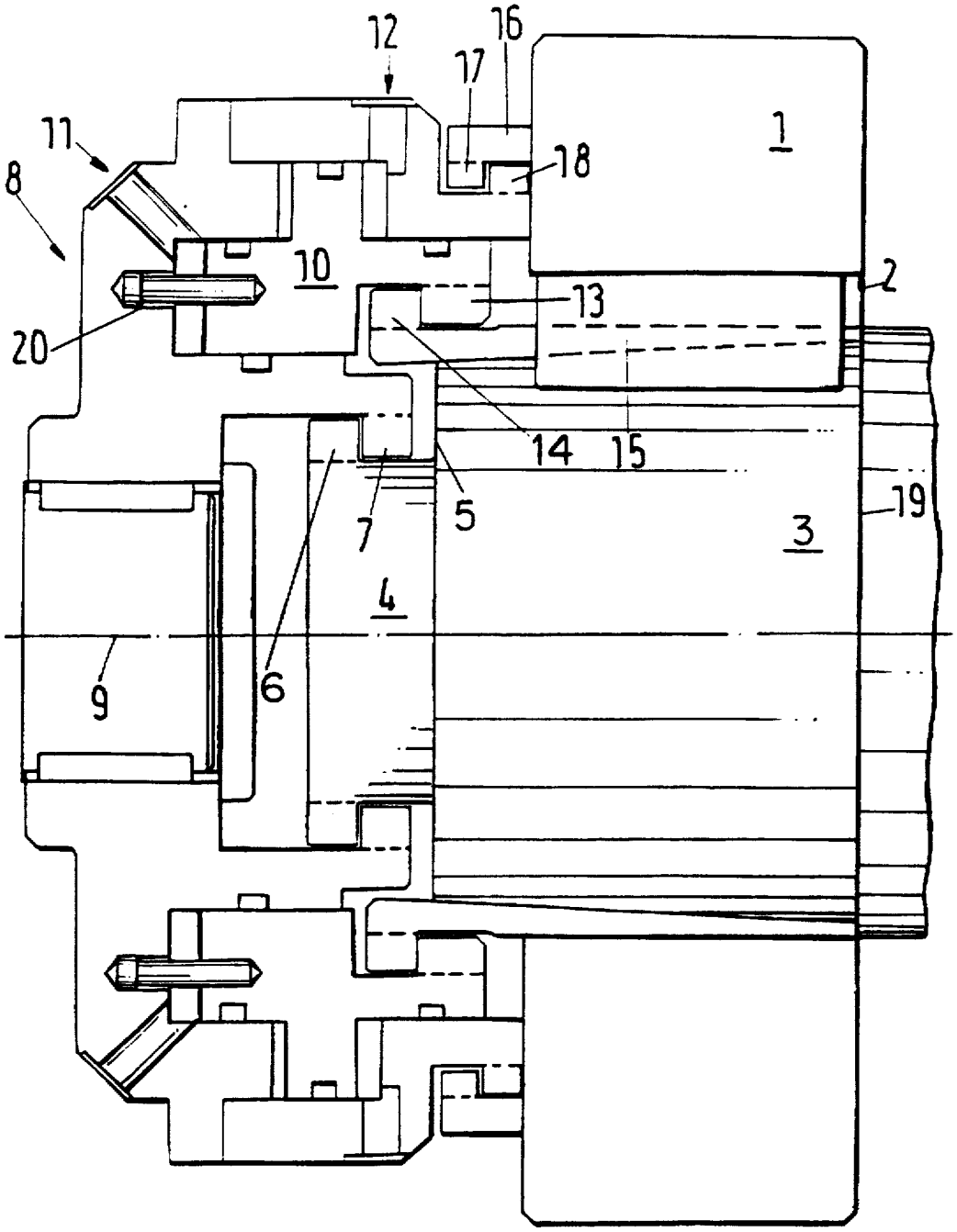
FIG. 1 is a longitudinal section through a quick-changing device according to the present invention.

In FIG. 1, a roll disk 1 is connected to a roll shaft 3 via a shaft spring connection 2. The roll shaft 3 has a roll shaft piece 4 on its front-face end 5. The roll shaft piece 4 is provided with claws 6 which extend radially outward over perimeter segments. The claws 6 are gripped from behind by further claws 7 of an installation-and-removal device 8. The further claws 7 extend radially inward on the side of the installation-and-removal device 8 facing the roll shaft 3 and form a type of bayonet joint with the claws 6 of the roll shaft piece 4.

A ring piston 10 extends parallel to the axis 9 of the roll shaft 3 and is movable coaxially relative to the axis 9 of the roll shaft 3. To move the ring piston 10, both sides 11, 12 can be acted upon by a pressure medium. A bolt 20 runs in moveable fashion between the ring piston 10 and the installation-and-removal device 8 and prevents the ring piston 10 from turning around the axis 9 of the roll shaft 3. On the front of the ring piston 10 facing the roll disk 1, claws 13, which also extend over perimeter segments, extend radially inward and grip respective corresponding claws 14 of a taper bushing 15 from behind. The claws 14 are arranged on the elongated end of the taper bushing 15, which, when gripped between the roll disk 1 and the roll shaft 3, holds the roll disk 1 on the roll shaft 3 centered against a roll shaft shoulder 19.

Furthermore, according to the invention, the roll disk 1 has a similar bayonet-joint-type ring 16, which is located frontally on the roll disk 1 facing the installation-and-removal device 8. The ring 16 has claws 17 directed radially inward, which grip behind correspondingly designed claws 18 that are fixedly connected to the installation-and-removal device 8.

Figure 2:
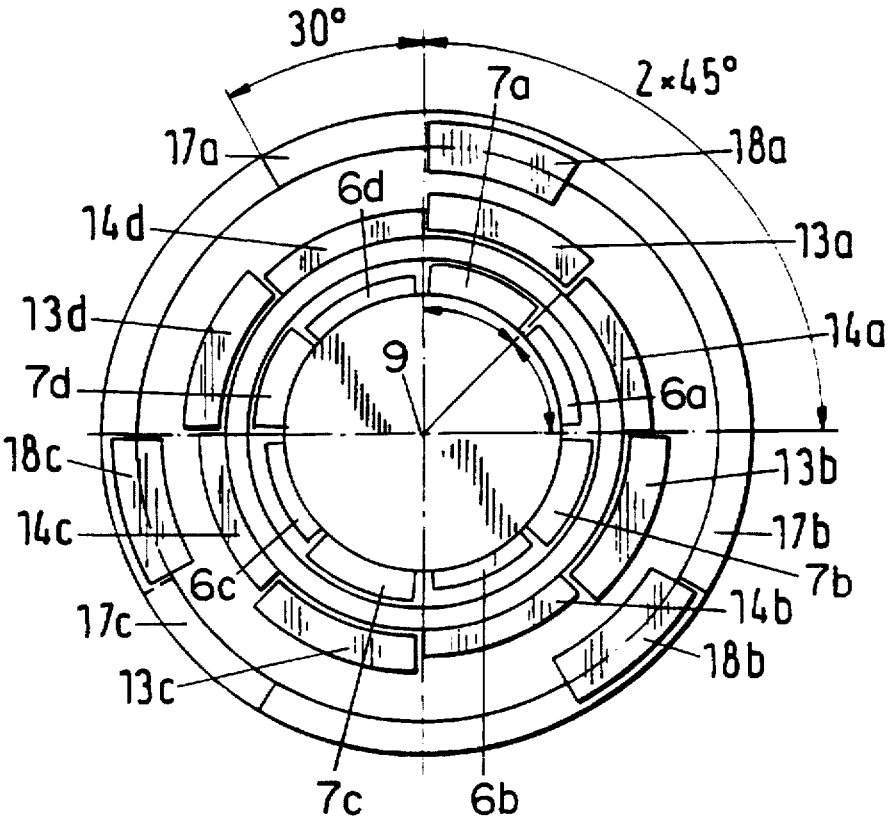
FIG. 2 is a view in the direction of the roll shaft axis, showing the arrangement of the claws of the quick-changing device.

The arrangement of the individual claws can be seen in FIG. 2. The connection of the claws 6, 7 between the roll shaft piece 4 and the installation-and-removal device 8 is conventional and shown in FIG. 2.

As FIG. 2 shows, the claws 13 of the ring piston 10, include four pieces which are distributed evenly around the perimeter over perimeter segments 13*a*, *b*, *c* and *d*, and extend over respective areas of 45 degrees each. The claws 13 correspond to the four claws 14 of the taper bush 15 that extend over the perimeter segments 14*a*, *b*, *c*, and *d* and are similarly arranged over 45 degree areas. The claws 17 on the ring 16 extend over the perimeter segments 17*a*, 17*b* and 17*c*, are evenly distributed around the perimeter and extend over 30° each. The claws 18, of the installation-and-removal device 8 correspond to the claws 17, similarly extend over three perimeter segments 18*a*, *b*, and *c* of 30 degrees each, and are evenly distributed around the perimeter. The arrangement of the perimeter segments relative to one another can be seen in FIG. 2, which shows the position in which the installation-and-removal device 8 can be mounted on the roll shaft 3.

The device according to the invention will now be further described in reference to its functional steps. The roll disk 1 is attached to the roll shaft 3 by means of the taper bushing 15 inserted between the roll disk 1 and the roll shaft 3. The roll disk 1 lies on the shoulder 19 of the roll shaft 3 (on the right in FIG. 1). The roll disk 1 is secured against rotation on the roll shaft 3 by the shaft spring connection 2. In the position of the individual claws shown in FIG. 2, the installation-and-removal device 8 is slipped onto the roll shaft 3 and turned through 45 degrees. As a result, the claws 7*a*, 7*b*, 7*c* and 7*d* of the installation-and-removal device 8 come to rest behind the claws 6*a*, 6*b*, 6*c* and 6*d* of the roll shaft piece 4 and the claws 13 of the ring piston 10 come to rest behind the claws 14 of the taper bushing 15. In reference to FIG. 2, this means that the perimeter segments 13*a*, 13*b*, 13*c* and 13*d*, respectively, grip behind the perimeter segments 14*a*, 14*b*, 14*c*, and 14*d*. In this position, hydraulic pressure is exerted on the side 12 of the ring piston 10 so that the taper bushing 15 is pulled out of the gripped connection between the roll disk 1 and the roll shaft 3 via the claws 13 and thus the roll disk is released.

The installation-and-removal device 8 is then turned by another 45 degrees, so that the claws 18 come to rest behind the claws 17 on the ring 16 of the roll disk 1. The perimeter segment (FIG. 2) 18*a* is behind 17*b*; 18*b* is behind 17*c*; and 18*c* is behind 17*a*. In this turned position, the installation-and-removal device 8 can be withdrawn together with the roll disk 1 from the roll shaft 3, because the claw pairs 13, 14 and 6, 7 are at vacant interstices. The roll disk 1 remains connected to the installation-and-removal device via the claw pairing 17, 18, so that the roll disk 1 gripped together with the installation-and-removal device 8 can be removed.

The installation procedure of the roll disk is carried out in the reverse manner. When the installation-and-removal device 8 is mounted on the roll shaft 3, the installation-and-removal device 8 is first turned by 45 degrees, so that the claw pairs 6, 7 come to rest one behind the other. When the ring piston is subjected to slight pressure at 12, the perimeter segments 18*a*, 18*b*, 18*c* are brought to rest on the front of the roll disk 1 and press the latter against the roll shaft shoulder 19. Then the other surface of the ring piston 10 is subjected to significantly greater pressure at 11. As a result of this pressure the ring piston comes to rest with its front against the perimeter segments 14*a*, *b*, *c*, and *d* of the taper bushing 15 and presses the bushing 15 between the roll disk 1 and the roll shaft 3 in the direction of the roll shaft shoulder 19. Turning the installation-and-removal device 48 by another 45 degrees brings all of the claw pairs into their vacant positions, so that an axial withdrawal of the installation-and-removal device 8 is possible.

The invention is not limited by the embodiments described above which are presented as examples only but can be modified in various ways within the scope of protection defined by the appended patent claims.

I claim:

1. A quick-changing device for changing a roll disk arranged in a free-floating fashion on a roll shaft and braced adjacently against a shoulder of the roll shaft, the device comprising:

a roll disk;

a roll shaft piece connectable to an end face of the roll shaft and having radially outwardly projecting claws;

an axially-moveable installation-and-removal unit configured to be placeable frontally on the roll shaft so as to be turnable coaxially to the roll shaft, the installation-and-removal unit having radially extending claws that form perimeter segments, the claws of the installation-and-removal unit including first claws, second claws and third claws, the first claws being configured to correspond to and engage with the claws of the roll shaft piece;

a taper bushing slidably arrangeable between the roll disk and the roll shaft whereby the roll disk is holdable on the roll shaft, the taper bushing having radially extending claws, the second claws of the installation-and-removal unit being configured to correspond to and engage with the claws of the taper bushing; and a ring coaxially mounted on a side of the roll disk facing the installation-and-removal unit, the ring having radially extending claws that correspond to and are engageable behind the third claws of the installation-and-removal unit, all the claws being configured to have a perimeter extension whereby the corresponding claws lie perimetrically next to one another in a plane seen in the axial direction when the installation-and-removal unit is placed on the roll shaft, the installation-and-removal unit being turnable between a first position in which the claws of the roll shaft piece and the claws of the taper bushing respectively engage with the corresponding first claws and second claws of the installation-and-removal unit, and a second position in which only the claws of the ring engage with the corresponding third claws of the installation-and-removal unit whereby installation-and-removal of the roll disk is facilitated.

2. A quick-changing device for a roll disk as defined in claim 1, wherein the ring is configured as a bayonet catch.

3. A quick-changing device for a roll disk as defined in claim 1, wherein the corresponding claws of the roll shaft piece and the installation-and-removal unit, and the corresponding claws of the taper bushing and the installation-and-removal unit are evenly distributed perimetrically and respectively form perimeter segments of 45° each, the corresponding claws of the ring and the installation-and-removal unit are evenly distributed perimetrically and respectively form perimeter segments of approximately 30° each.

4. A quick-changing device for a roll disk as defined in claim 1, wherein the installation-and-removal unit includes a housing and a coaxial ring piston non-rotatably arranged in the housing and having two sides, the second claws of the installation-and-removal unit being mounted to the coaxial ring piston, and further comprising means for subjecting the ring piston to a pressure medium on both sides.

5. A quick-changing device for a roll disk as defined in claim 4, wherein the ring piston is configured so that it can be placed frontally against at least one of the taper bushing and the roll disk.

* * * * *